US006330012B1

(12) United States Patent
Irie

(10) Patent No.: US 6,330,012 B1
(45) Date of Patent: Dec. 11, 2001

(54) IMAGE FORMING SYSTEM

(75) Inventor: Yukio Irie, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 09/312,953

(22) Filed: May 17, 1999

(30) Foreign Application Priority Data

May 18, 1998 (JP) ..... 10-135777

(51) Int. Cl.[7] ..... B41J 2/365
(52) U.S. Cl. ..... 347/195
(58) Field of Search ..... 347/180–182, 347/186, 194–195, 171; 400/120.16

(56) References Cited

U.S. PATENT DOCUMENTS

| | | | | |
|---|---|---|---|---|
| 4,649,401 | * | 3/1987 | Kojima et al. | 347/211 |
| 4,843,408 | | 6/1989 | Tanaka | 347/182 |
| 5,003,323 | | 3/1991 | Onuki et al. | 347/171 |
| 5,025,267 | * | 6/1991 | Schofield et al. | 347/194 |
| 5,038,154 | | 8/1991 | Yamamoto et al. | 347/180 |
| 5,412,405 | | 5/1995 | Nureki et al. | 347/182 |

FOREIGN PATENT DOCUMENTS

| | | | | |
|---|---|---|---|---|
| 41 23 221 A1 | | 1/1993 | (DE) . | |
| 0 501 707 A2 | * | 2/1992 | (EP) | B41J/2/355 |
| 0 593 071 A1 | | 4/1994 | (EP) . | |
| 0 774 358 A1 | | 5/1997 | (EP) . | |
| 60-161163 | | 8/1985 | (JP) . | |
| 45170 | | 12/1989 | (JP) . | |

* cited by examiner

*Primary Examiner*—N. Le
*Assistant Examiner*—K. Feggins
(74) *Attorney, Agent, or Firm*—Nixon Peabody LLP; Donald R. Studebaker

(57) ABSTRACT

An image forming system includes a thermal head having a linear array of a plurality of heater elements extending in a direction of the main scanning, and a head driver which drives the thermal head on the basis of image data to selectively operate the respective heater elements according to image data while the thermal head is being moved relative to a recording medium in a direction of the sub-scanning, thereby forming a copy of the image represented by the image data on the recording medium line by line. The heater elements are divided into a plurality of head blocks which are contiguous in the main scanning direction, and the head driver is provided with a plurality of head drive segments of the same number as the number of the head blocks. Image data consisting of a plurality of pieces of line image data is stored in a memory. Each line image data consists of a plurality of image data fractions which are of the same number as the number of the head drive segments. When contiguous multi-imaging is to be carried out, the image data fraction of each of the pieces of line image data corresponding to the part to be multiplied of the image is input into the head drive segments which drive the head blocks corresponding to the positions where the copies are to be formed.

6 Claims, 12 Drawing Sheets

IMAGE FORMING SYSTEM

BACKGROUND OF THE INVENTION

1. Field of the Invention

This invention relates to an image forming system, and more particularly to an image forming system which can form a plurality of identical images arranged in a row or rows.

2. Description of the Related Art

There has been known an image forming system such as a printer (e.g., a thermal printer, a stencil printer and the like) or a copier which reproduces or outputs an image, for instance, on a printing paper on the basis of an image signal read out from an original, for instance, by a CCD line sensor.

For example, in a stencil printer, an image on an original is read out from the original by an image read-out section, whereby an image signal representing the image is obtained. Then a stencil master material is perforated in an imagewise pattern on the basis of the image signal by an image writing section comprising a thermal head and a platen roller, thereby making a stencil master. The stencil master is wound around a printing drum and ink is transferred through the stencil master to printing papers which are supplied between the printing drum and a press roller pressed against the printing drum. In this manner, the image on the original is printed.

In such a stencil printer, it is sometimes necessary to print an image of an original of a small size (e.g., B6 size) a plurality of times on a larger size printing paper (e.g., of B4 size), for instance, so that four copies of the image are printed on the larger size printing paper side by side in two rows. Such function will be referred to as "contiguous multi-imaging", and the image a plurality of copies of which are to be printed on a printing paper will be referred to as "the image to be multiplied", hereinbelow. When performing contiguous multi-imaging, a line memory such as a RAM has been generally used in order to form a plurality of copies arranged side by side in the direction of the main scanning.

Specifically, as disclosed, for instance, in Japanese Utility Model Publication No. 1(1989)-45170, a plurality of duplicates of image data are made on the line memory by handling the image data as single-bit serial data (binary image data) and storing the same image data at a plurality of addresses by address control of the line memory, and the line memory is thus caused to store image data for contiguous multi-imaging. Accordingly a line memory which is of a single bit in data width is employed.

A thermal head which is employed as an output head in making a stencil master comprises a linear array of a plurality of heater elements each corresponding to one picture element. The heater elements are selectively energized according to image data while the thermal head is being moved relative to a stencil master material in the direction of sub-scanning (the direction substantially perpendicular to the direction in which the linear array of the heater elements extends) to make a stencil master by perforating the stencil master material in an imagewise pattern line by line on the basis of the image data. When the stencil master is made by use of such a thermal head, there has been a problem that heat energy gradually accumulates in each heater element as the stencil master making progresses. This becomes more serious as the stencil master making speed is increased since heat energy generated in the heater element when perforating along a certain line cannot be sufficiently dissipated before starting perforation along the next line. As a result, heat energy accumulates in each heater element according to its heat history and fluctuation in energy condition is generated among the heater elements, which results in deterioration in image quality. When the stencil master making speed is increased by dividing the heater elements of one thermal head into a plurality of blocks which can be driven separately from each other and driving the blocks in parallel, the aforesaid problem is somewhat alleviated. However as the stencil master making speed is further increased, the problem arises again.

There has been proposed "heat-history-based control" in order to overcome the aforesaid problem due to the heat history of each heater element. That is, in the heat-history-based control, heat history of each heater element and those around the heater element is stored in a line memory such as a RAM, and power to be applied to each heater element for perforation of a given line is controlled taking into account the heat history of the heater element and those around the heater element so that the heat energy in the heater elements is uniformed. The heat-history-based control becomes more essential to an image forming system using such a thermal head as the image forming speed increases. See, for instance, Japanese Unexamined Patent Publication Nos. 60(1985)-161163 and 2(1990)-8065.

There has been a demand for a stencil printer which can perform the contiguous multi-imaging at a high speed. In order to meet this demand, the stencil printer must be provided with both the contiguous multi-imaging function and the heat-history-based control function. Such a stencil printer may be realized by separately providing the stencil printer with both a memory for contiguous multi-imaging and a memory for heat-history-based control.

FIG. 13 is a block diagram showing the part for executing contiguous multi-imaging and heat-history-based control of a stencil printer system provided with both a memory for contiguous multi-imaging and a memory for heat-history-based control. In the heat-history-based control of this system, heat-history-based correction image data is made on the basis of the image data for a current line (the line to be formed next) and that for the preceding line and heat-history-based control is performed according to the heat-history-based correction image data. In this system, binary image data in the form of single-bit serial data is input into a data control means 80 for the contiguous multi-imaging. The image data input into the data control means 80 is stored in a RAM 82 at addresses designated by an address control means 84. Normally the address control means 84 increments the address one by one and input image data is stored in the RAM 82 as single-bit data. When a contiguous multi-imaging is on, the image data for the image to be multiplied is stored in a plurality of addresses the number of which is designated by the address control means 84 according to the number of the copies to be formed in the contiguous multi-imaging mode (this number will be referred to as "the number of multiplication", hereinbelow). In this case, though the identical image data is stored at different addresses, the image data is stored at each address as single-bit data.

A data control means 90 for heat-history-based control reads out data in sequence from the RAM 82 and stores the data in a RAM 92 which functions as a two-line memory. At this time, the single-bit data read out from the RAM 82 is divided by the number of blocks (four in this particular example) in the thermal head into four image data fractions which are contiguous in the direction in which the thermal head extends (the direction of the main scanning), and the image data fractions are recorded in the RAM 92 at different bits, whereby the single-bit data read out from the RAM 82 is stored in the RAM 92 as four-bit (equal to the number of blocks in the thermal head) data.

Then a heat-history-based correction image data making section 64 of an output control means 66 reads out the preceding line image data and the current line image data from the RAM 92 and makes heat-history-based correction image data. As shown in FIG. 14, the heat-history-based correction image data is obtained by taking a Boolean intersection of inverted preceding line image data and the current line image data. A data selecting section 67 of the output control means 66 inputs the heat-history-based correction image data made by the heat-history-based correction image data making section 64 into a TPH drive section 72 of a head drive means 70. The TPH drive section 72 drives the blocks 21*a* to 21*d* of the thermal head 21 separately from each other on the basis of a control signal from a TPH control signal generating section 74. After the thermal head 21 is driven according to the heat-history-based correction image data, the current line image data is subsequently input into the TPH drive section 72 from the data selecting section 67 and the thermal head 21 is driven according to the current line image data.

That is, when the current line image data for a heater element which was energized by the preceding line image data represents that the heater element is to be energized, the heat-history-based correction image data is set to represent that the heater element is not to be energized, and when the current line data for a heater element which was not energized by the preceding line image data represents that the heater element is to be energized, the heat-history-based correction image data is set to represent that the heater element is to be energized. Accordingly, heater elements which were not energized by the preceding line image data are energized by both the heat-history-based correction image data and the current line image data, whereby they are energized for a longer time, and heater elements which were energized by the preceding line image data are energized by only the current image data, whereby they are energized for a shorter time. That is, in the heat-history-based control in this example, the heat-history-based correction image data and the current line image data are input into the TPH drive section 72 in sequence for each line, and heater elements which were energized by the preceding line image data are energized by only the current line image data while heater elements which were not energized by the preceding line image data are energized by both the heat-history-based correction image data and the current line image data.

However RAMs which are currently available at low cost, especially those having a low capacity suitable for the contiguous multi-imaging, are not of a single-bit structure but of a multiple-bit structure, e.g., four-bit or eight-bit, and single-bit RAMs are comparatively high in cost. When the four-bit or eight-bit RAMs are used as a single-bit RAM, the remaining three or seven bits are held unused in vain, which renders the RAM expensive after all.

Further since using both memories exclusively for the contiguous multi-imaging and for the heat-history-based control is uneconomical and requires a larger space, it is preferred that a single memory be used for both the contiguous multi-imaging and the heat-history-based control. Further when the heater elements of the thermal head are divided into a plurality of blocks in order to increase the imaging forming speed, the memory for the heat-history-based control must be provided with bits of a number not smaller than the number of the blocks, which makes it infeasible to use a memory both for the heat-history-based control and the contiguous multi-imaging. That is, in order to increase the image forming speed while performing the contiguous multi-imaging using a single-bit memory, it is necessary to use a memory for the heat-history-based control separately from the memory for the contiguous multi-imaging.

Further there has been a demand for equalizing action of the system during the contiguous multi-imaging to that during the normal output. Especially in the case where the heater elements of a thermal head are divided into a plurality of blocks, it is not always effective to store identical image data in a memory at a plurality of addresses by address control when the contiguous multi-imaging is to be performed since the data is controlled separately for each block.

SUMMARY OF THE INVENTION

In view of the foregoing observations and description, the primary object of the present invention is to provide an image forming system in which the contiguous multi-imaging is performed in a manner which is different from that in the conventional system and makes it feasible to increase the image forming speed without use of a memory exclusively for the heat-history-based control.

An image forming system of the present invention basically comprises an output head having a linear array of a plurality of image forming elements extending in a first direction (direction of the main scanning), and a head drive means which drives the output head on the basis of image data to selectively operate the respective image forming elements of the output head according to image data while the output head is being moved relative to a recording medium in a second direction (direction of the sub-scanning) substantially perpendicular to the first direction, thereby forming a copy of the image represented by the image data on the recording medium line by line. The image forming elements of the output head are divided into a plurality of head blocks which are contiguous in the first direction, and the head drive means is provided with a plurality of head drive segments of the same number as the number of the head blocks, and each head drive segment drives one of the head blocks separately from each other in one-to-one correspondence. The image forming system of the present invention is characterized by having a memory in which image data consisting of a plurality of pieces of line image data is stored, each line image data consisting of a plurality of image data fractions which are of the same number as the number of the head drive segments of the head drive means and are contiguous in the first direction; a contiguous multi-imaging signal generating means which generates a contiguous multi-imaging signal which represents that a plurality of copies of a part of the image represented by the image data are to be formed on the recording medium arranged in the first direction, and designates the part to be multiplied of the image and the positions where the copies are formed; and an output control means which normally inputs the image data read out from the memory into the head drive means line image data by line image data so that the image data fractions are input into the respective corresponding head drive segments, and when the contiguous multi-imaging signal is generated, inputs the image data fraction of each of the pieces of line image data corresponding to the part to be multiplied of the image designated by the contiguous multi-imaging signal into the head drive segments which drive the head blocks corresponding to the positions where the copies are formed designated by the contiguous multi-imaging signal in place of the image data fractions of each line image data which is normally to be input into the head drive segments.

An image forming system in accordance with an embodiment of the present invention is characterized by having a memory which can store a plurality of bits of a number equal to or more than the number of the head blocks at each address; a memory control means which divides each piece of line image data making up the image data into a plurality of image data fractions of the same number as the number of the head drive segments of the head drive means and causes the memory to store the image data fractions in different bits at the same addresses; a read-out control means which reads out the image data fractions of the line image data from the memory; a contiguous multi-imaging signal generating means which generates a contiguous multi-imaging signal which represents that a plurality of copies of a part of the image represented by the image data are to be formed on the recording medium arranged in the first direction, and designates the part to be multiplied of the image and the positions where the copies are to be formed; and an output control means which normally inputs the image data read out from the memory into the head drive means line image data by line image data so that the image data fractions are input into the respective corresponding head drive segments, and when the contiguous multi-imaging signal is generated, inputs the image data fraction of each of the pieces of line image data corresponding to the part to be multiplied of the image designated by the contiguous multi-imaging signal into the head drive segments which drive the head blocks corresponding to the positions where the copies are to be formed designated by the contiguous multi-imaging signal in place of the image data fractions of each line image data which is normally to be input into the head drive segments.

The output head is, for instance, a thermal head.

In the case where the output head is a thermal head, it is preferred that the memory control means causes the memory to store each line image data with the image data for the preceding line held therein, the read-out control means reads out the image data fractions of the line image data from the memory together with the image data fraction of the line image data for the preceding line, and the output control means, when the contiguous multi-imaging signal is generated, corrects the image data fraction of the line image data corresponding to the part to be multiplied of the image designated by the contiguous multi-imaging signal according to heat history of the heater elements to be driven by the image data fraction represented by the image data fraction of the line image data for the preceding line for the same head block as the image data fraction of the line image data corresponding to the part to be multiplied of the image, thereby forming a corrected head drive data fraction, and inputs the corrected head drive data fraction into the head drive segments which drive the head blocks corresponding to the positions where the copies are to be formed designated by the contiguous multi-imaging signal.

For example, the output control means makes a heat-history-based correction image data fraction for correcting the image data fraction of the line image data corresponding to the part to be multiplied of the image designated by the contiguous multi-imaging signal according to heat history of the heater elements to be driven by the image data fraction represented by the image data fraction of the line image data for the preceding line for the same head block as the image data fraction of the line image data corresponding to the part to be multiplied of the image, and inputs the image data fraction of each of the pieces of line image data corresponding to the part to be multiplied of the image into the head drive segments which drive the head blocks corresponding to the positions where the copies are to be formed in combination with the heat-history-based correction image data fraction.

For example, the heat-history-based correction image data may be obtained by taking a Boolean intersection of the image data fraction of each line image data corresponding to the part to be multiplied of the image and the inverted image data fraction of the line image data for the preceding line for the same head block.

In the image forming system of the present invention, when the contiguous multi-imaging is to be carried out, the image data fraction of each line image data corresponding to the part to be multiplied of the image represented by the input image data is input into the head drive segments which drive the head blocks corresponding to the positions where the copies are formed designated by the contiguous multi-imaging signal without storing a series of image data for the contiguous multi-imaging where an identical image data fraction appears a plurality of times as in the prior art, and accordingly the system can operate with a high efficiency.

Further when the memory is caused to store the image data fractions in different bits at the same addresses as multiple-bit data, and the image data fraction of each line image data corresponding to the part to be multiplied of the image represented by the input image data is read out from the memory and input into the head drive segments which drive the head blocks corresponding to the positions where the copies are formed designated by the contiguous multi-imaging signal a multiple-bit memory can be efficiently employed for the contiguous multi-imaging.

This arrangement is further advantageous when a thermal head is employed as the output head in that since the data for carrying out the heat-history-based control and the data for carrying out the contiguous multi-imaging can be the same in the number of bits, a single memory can be employed both for the heat-history-based control and the contiguous multi-imaging.

DESCRIPTION OF THE PREFERRED EMBODIMENT

Figure 1:
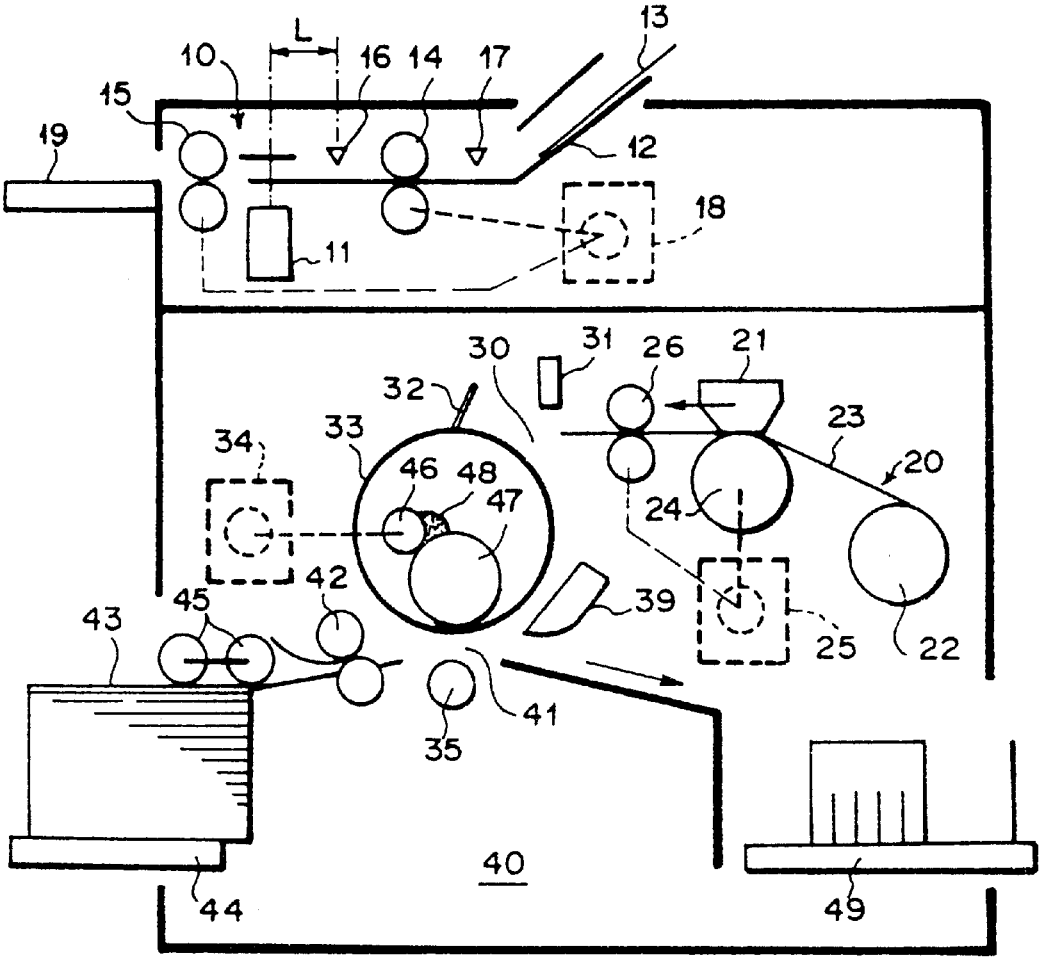
FIG. 1 is a cross-sectional view of a stencil printer provided with an image forming system in accordance with an embodiment of the present invention as a stencil printer making system.

In FIG. 1, a stencil printer provided with an image forming system in accordance with an embodiment of the present invention as a stencil printer making system comprises a stencil master making system and a printing section 40. The stencil master making section comprises an image read-out section 10, an image writing section 20 provided with a thermal head 21 and a cutter section 30.

The image read-out section 10 comprises an original set table 12 to which an original 13 is set, an original sensor 17 which detects the original 17 set to the original set table 12, a pair of original conveyor rollers 14 which are driven by a stepping motor 18 which operates upon receipt of a detecting signal from the original sensor 17, a close contact type line image sensor 11 which optically reads out an image on the original 13 and outputs an electric image signal representing the image, and a pair of original discharge rollers 15 which are driven by the stepping motor 18 to discharge the original 13 to an original discharge tray 19 after the line image sensor 11 reads out the image on the original 13. An original-in sensor 16 is disposed downstream of the original conveyor rollers 14 and when the original-in sensor 16 detects the original 13, the image writing section 20 starts to operate.

The image writing section 20 comprises a thermal head 21 comprising four head blocks 21*a* to 21*d*, each consisting of a plurality of heater elements 21*z* (FIG. 7), a platen roller 24 which is driven by a stepping motor 25 and conveys a stencil master material 23 fed out from a stencil master roll 22 while pressing the stencil master material 23 against the thermal head 21, and a pair of stencil master conveyor rollers 26 which are driven by the stepping motor 25 and conveys the stencil master material 23 toward a clamping portion 32 of a printing drum 33 to be described later.

The cutter section 30 is provided with a cutter 31 which cuts a stencil master thus formed (a stencil master material which has been perforated by the thermal head 21) off the stencil master roll 22. In this specification, the stencil master is also denoted by 23.

The printing section 40 comprises a printing drum 33 having a built-in ink supply system which supplies a predetermined amount of ink to the inner surface of the printing drum 33 from an ink well formed between a doctor roller 46 and a squeegee roller 47, a pickup rollers 45 which pick up and convey printing papers 43 one by one from a stack of the printing papers 43 on a paper supply table 44, a timing roller 42 which feeds out the printing paper 43 conveyed by the pickup rollers 45 at a predetermined timing, a press roller 35 which presses the printing paper 43, conveyed to a conveying passage 41 by the timing roller 42, against the outer circumferential surface of the printing drum 33, a separator member 39 which separates the printing paper 43 from the printing drum 33 after printing, and a printing paper discharge table 49 on which the printing papers 43 separated from the printing drum 33 are stacked.

The printing drum 33 is provided with a clamping portion 32 which clamps the leading end portion of the stencil master 23, and the stencil master 23 is wound around the printing drum 33 by rotating the printing drum 33 by a main motor 34 with the leading end portion of the stencil master 23 clamped by the clamping portion 32.

Figure 2:
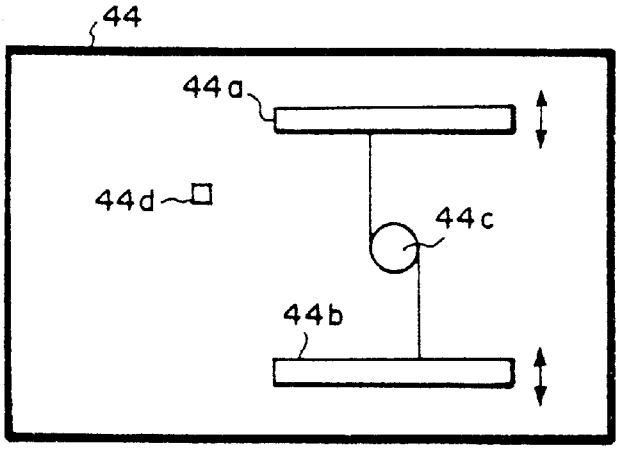
FIG. 2 is a plan view of the paper supply table of the stencil printer.

FIG. 2 is a plan view of the paper supply table 44. The paper supply table 44 is provided with left and right fences 44*a* and 44*b* which are movable and for fixing the paper supply position. A size detecting means 44*c* detects the size of the printing papers 43 by way of the positions of the left and right fences 44*a* and 44*b*, and a paper position sensor 44*d* detects whether the printing papers 43 are positioned lengthwise or sidewise.

Though not shown, the stencil printer is provided with a control panel, and a start key which starts the stencil master making operation and/or the printing operation, a contiguous multi-imaging key for setting the contiguous multi-imaging mode, a ten-key pad for inputting the number of identical images to be formed on the stencil master 23 in the contiguous multi-imaging and/or the number of copies to printed, and a display means, which may comprise, for instance, a liquid crystal display, for displaying the number of identical images to be formed on the stencil master 23 in the contiguous multi-imaging, the number of copies to printed, that the contiguous multi-imaging mode has been set, and the like are provided on the control panel.

Figure 3:
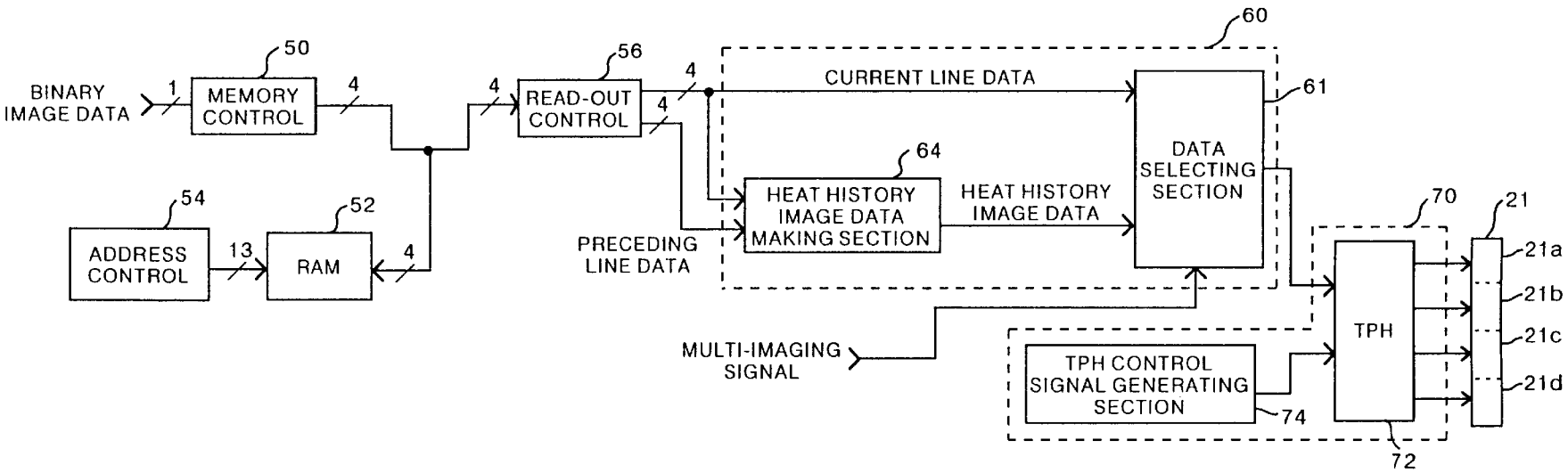
FIG. 3 is a block diagram which mainly shows the part of the image writing section related to the contiguous multi-imaging function and the heat-history-based control function.

FIG. 3 is a block diagram which mainly shows the part of the image writing section 20 related to the contiguous multi-imaging function and the heat-history-based control function.

This system is for B4 size, 400 dpi and the thermal head 21 has 4096 heater elements 21*z* in total. Each of the blocks 21*a* to 21*d* has 1024 heater elements 21*z*. Four signals, i.e., image data DAT, clock CLK, a latch signal LAT and an energizing signal ENL, are input into each of the blocks 21*a* to 21*d* and the thermal head 21 is driven on the basis of these signals as will be described in detail later.

The image writing section 20 is provided with a RAM 52 in which data of a pluarlity of bits of the same number as the total number of the head blocks (four in this particular embodiment) can be stored at an address, and the binary image data for the current line read out by the image read-out section 10 is divided by a memory control means 50 into four image data fractions which are contiguous in the direction in which the thermal head 21 extends, i.e., the direction of the main scanning. The image data fractions are recorded in the RAM 52 at different bits, whereby the input single-bit image data is stored in the RAM 52 as four-bit data. As described in detail later, the image data for the current line is stored in the RAM 52 with the image data for the preceding line held in the RAM 52.

A read-out control means 56 reads out the current line image data and the preceding line image data stored in the RAM 52 and inputs them into an output control means 60.

The output control means 60 has a heat-history-based correction image data making section 64 which makes heat-history-based correction image data on the basis of the preceding line image data for each heater element 21z and the current line image data for the same heater element 21z. The heat-history-based correction image data forms a part of data for driving the head blocks 21a to 21d of the thermal head 21.

The output control means 60 is further provided with a data selecting section 61 which inputs each image data fraction read out from the bit into one of segments 72a to 72d (FIG. 7) of a TPH drive 72 as a head drive data fraction during the normal output. The segments 72a to 72d respectively drive the head blocks 21a to 21d which correspond to the image data fractions in one-to-one correspondence. When a plurality of copies of an image are to be printed side by side (the contiguous multi-imaging) arranged in the direction of main scanning, the data selecting section 61 inputs the image data fraction read out from the bit representing the image to be multiplied into a plurality of segments of the TPH drive 72 as the head drive data fraction, which segments are designated by a multi-imaging signal to be described later. Further the data selecting section 61 inputs also the heat-history-based correction image data fraction corresponding to each head block made by the heat-history-based correction image data making section 64 into the corresponding segment of the TPH drive 72 as a part of the head drive data fraction.

The operation of the stencil printer will be described in detail, hereinbelow.

Figure 4A:
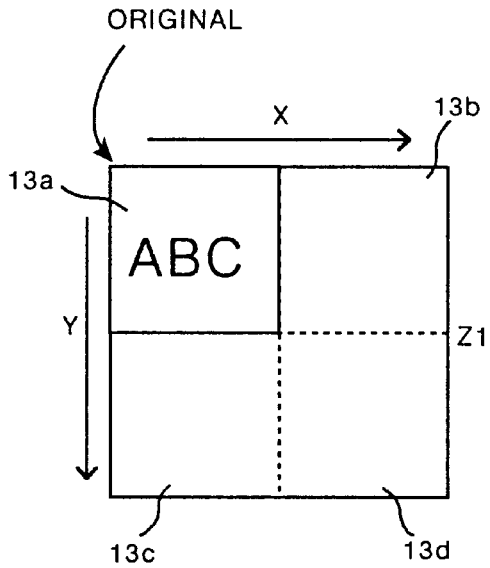
FIGS. 4A and 4B are views showing the correspondence between the original and the stencil master when four copies of the image of the original is to be formed on the stencil master in two rows two in each row.
Figure 4B:
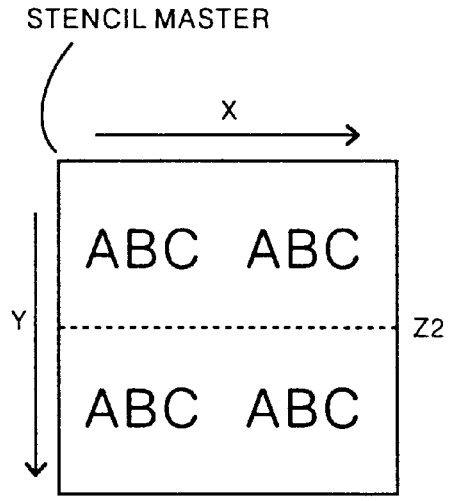

When an original 13 is set to the original set table 12 and the original 13 is brought into abutment against the original conveyor rollers 14, the original sensor 17 detects the original 13 and a display to the effect that the stencil master making is feasible is made by the display means. Then when the contiguous multi-imaging key is pressed, a display to the effect that the contiguous multi-imaging mode can be set is made by the display means. In this state, the number of the copies to be formed in the contiguous multi-imaging can be set through the ten-key pad. A case where four copies of an image on an original of B6 size shown in FIG. 4A are formed on a stencil master of B4 size in two rows, two in each row, as shown in FIG. 4B will be described by way of example hereinbelow.

When the start key is pressed after the number of copies to be formed in the contiguous multi-imaging is set by the ten-key pad, the size detecting means 44c detects the size of the printing papers 43 stacked on the paper supply table 44 which is B4 in this example, and a display to the effect that the paper size is B4 is made by the display means. Then the original conveyor rollers 14 are driven by the stepping motor 18 to start conveying the original 13. When the original 13 is conveyed by a distance L (FIG. 1) after the original-in sensor 16 detects the leading end of the original 13, the platen roller 24 is driven to start conveying the stencil master material 23.

At the same time, the close contact type line image sensor 11 optically reads out the image on the original 13 and inputs an electric image signal representing the image into the image writing section 20. Then the image writing section 20 perforate the stencil master material 23 on the basis of the image signal to form a pair of perforation images, each representing the image on the original 13, arranged side by side in the direction of the main scanning as shown in FIG. 4B. Thus a half of the stencil master 23 (up to line z2 in FIG. 4B) is made. This will be referred to as "the primary stencil master making", hereinbelow.

After the primary stencil master making, the stencil master 23 is fed by the platen roller 24 by a predetermined distance and then stopped. Thereafter the original 13 is discharged.

In the case where the original 13 is of B4 size, and two copies of the image of a part of the B4 size original 13, e.g., the area denoted by 13a, are to be printed side by side on a B4 size printing paper, the image read-out section 10 reads out the image over the entire width of the B4 size original, and the image writing section 20 perforates the stencil master material 23 on the basis of the image signal representing the area 13a, thereby performing the primary stencil master making. In this case, the image read-out section 10 may read out the image only up to the lower end of the area 13a shown by line z1 in FIG. 4A or may read out the image over the entire area of the B4 size original 13. In either case, the original conveyor rollers 14 and the original discharge rollers 15 are kept driven until the original 13 is discharged to the original discharge tray 19 while the platen roller 24 which conveys the stencil master material 23 is stopped when the thermal head 21 comes to the line z2 or a predetermined position after the line z2 from which a secondary stencil master making (to be described later) is started.

When the original 13 is of B6 size, no image data is input into the segments 21c and 21d of the TPH drive section 21. However, even in such a case, it is considered that image data representing a blank area is input into the segments 21c and 21d in this specification.

It is possible to arrange the system so that the read starting position in the sub-scanning direction can be set through, for instance, the ten-key pad.

Further it is possible to arrange the system so that the original 13 is automatically set again to the original set table 12 after the image read-out for the primary stencil master making is ended.

Though in this embodiment, the original 13 is conveyed in the sub-scanning direction relative to the image sensor 11 with the image sensor 11 fixed when the image on the original 13 is read out, the system may be arranged so that the image sensor 11 is moved in the sub-scanning direction relative to the original 13 with the original 13 fixed. Similarly, though in this embodiment, the stencil master material 23 is conveyed in the sub-scanning direction relative to the thermal head 21 with the thermal head 21 fixed when the thermal head 21 perforates the stencil master material 23, the system may be arranged so that the thermal head 21 is moved relative to the stencil master material 23 with the stencil master material 23 fixed after the stencil master material 23 is fed out from the roll 22 in a predetermined length.

After the primary stencil master making, a secondary stencil master making is effected. First a display to the effect that the original 13 is to be set again is made by the display means. When the original 13 is set again to the original set table 12, the image sensor 11 optically reads out the image on the original 13 and inputs an electric image signal representing the image into the image writing section 20. Then the image writing section 20 perforates the lower half of the stencil master material 23 on the basis of the image signal to form a pair of perforation images, each representing the image on the original 13, arranged side by side in the direction of the main scanning as shown in FIG. 4B. Thus the other half of the stencil master 23 (below the line z2 in FIG. 4B) is made. This will be referred to as "the secondary stencil master making".

Thereafter the stencil master material 23 is conveyed by a predetermined distance by the stencil master conveyor rollers 26 and the leading end portion thereof is clamped by the clamp portion 32 of the printing drum 33. Then the stencil master material 23 is wound around the printing drum 33 by rotating the printing drum 33 and then cut off by the cutter 31.

Thus the stencil master 23 made in the manner described above is wound around the printing drum 33 and printing becomes feasible.

The contiguous multi-imaging in the direction of the main scanning and the heat-history-based control will be described with reference to FIG. 3, hereinbelow. First storing the image data in the RAM 52 and reading out the image data from the same will be described. The image signal as read out by the image read-out section 10 is transferred to the image writing section 20 and is digitized into binary image data of single-bit. The image data for one line read by the image sensor 11 includes data components for 4096 heater elements 21*z* of the thermal head 21 each forming one picture element. The image data obtained by reading out a B6 size original includes data components for 2048 picture elements representing the area 13*a* in FIG. 4A and 2048 picture elements representing a vacant image. The image data obtained by reading out a B4 size original includes data components for 2048 picture elements representing the area 13*a* in FIG. 4A and 2048 picture elements representing the area 13*b* in FIG. 4A.

The image data including the data components for 4096 heater elements 21*z* of the thermal head 21 is once written in the RAM 32. The data components are stored at the following addresses on the basis of conversion to four-bit data by the memory control means 50 and address assignment by the address control means 54. In this embodiment, for the purpose of the heat-history-based control to be described later, the image data for the one line is stored in the RAM 52 with image data for a plurality of (three in this embodiment though may be at least two) preceding lines kept stored in the RAM 52.

The single-bit image data for the current line is divided by the number of blocks (four in this particular example) in the thermal head 21 into a plurality of (equal to the number of blocks in the thermal head) image data fractions which are contiguous in the direction in which the thermal head extends, i.e., the direction of the main scanning, and the image data fractions are recorded in the RAM 52 in different bits. Specifically the image data fraction including the image data components for first to 1024-th heater elements is stored in bit 0, the image data fraction including those for 1025-th to 2048-th heater elements is stored in bit 1, the image data fraction including those for 2049-th to 3072-th heater elements is stored in bit 2, and the image data fraction including those for 3073-th to 4096-th heater elements is stored in bit 3. Thus the each image data fraction is converted to four-bit data, and the four bit data is written in the corresponding bit of the RAM 52 while incrementing the RAM address from 0 to 1023 according to the number of the picture element (heater element) by the address control means 54 as shown in the following table 1.

TABLE 1

| picture element No. (current line) | addresses | bit |
|---|---|---|
| 1–1024 | 0–1023 | 0 |
| 1025–2048 | 0–1023 | 1 |
| 2049–3072 | 0–1023 | 2 |
| 3073–4096 | 0–1023 | 3 |

The image data for the next line is stored in each bit at addresses for the current line plus 2048 as shown in the following table 2.

TABLE 2

| picture element No. (next line) | addresses | bit |
|---|---|---|
| 1–1024 | 2048–3071 | 0 |
| 1025–2048 | 2048–3071 | 1 |
| 2049–3072 | 2048–3071 | 2 |
| 3073–4096 | 2048–3071 | 3 |

Similarly, the image data for the next line but one is stored in each bit at addresses for the next line plus 2048 as shown in the following table 3, and the image data for the next line but two is stored in each bit at addresses for the next line but one plus 2048 as shown in the following table 4.

TABLE 3

| picture element No. (next line but one) | addresses | bit |
|---|---|---|
| 1–1024 | 4096–5119 | 0 |
| 1025–2048 | 4096–5119 | 1 |
| 2049–3072 | 4096–5119 | 2 |
| 3073–4096 | 4096–5119 | 3 |

TABLE 4

| picture element No. (next line but two) | addresses | bit |
|---|---|---|
| 1–1024 | 6114–7167 | 0 |
| 1025–2048 | 6114–7167 | 1 |
| 2049–3072 | 6114–7167 | 2 |
| 3073–4096 | 6114–7167 | 3 |

The image data for the next line but three is stored in each bit at addresses equal to those for the current line, and the addresses for the following lines are incremented by 2048 for every line within four lines. Thus the RAM 52 functions as a line memory for four lines and the image data fractions for four lines are stored at different addresses.

Figure 5:
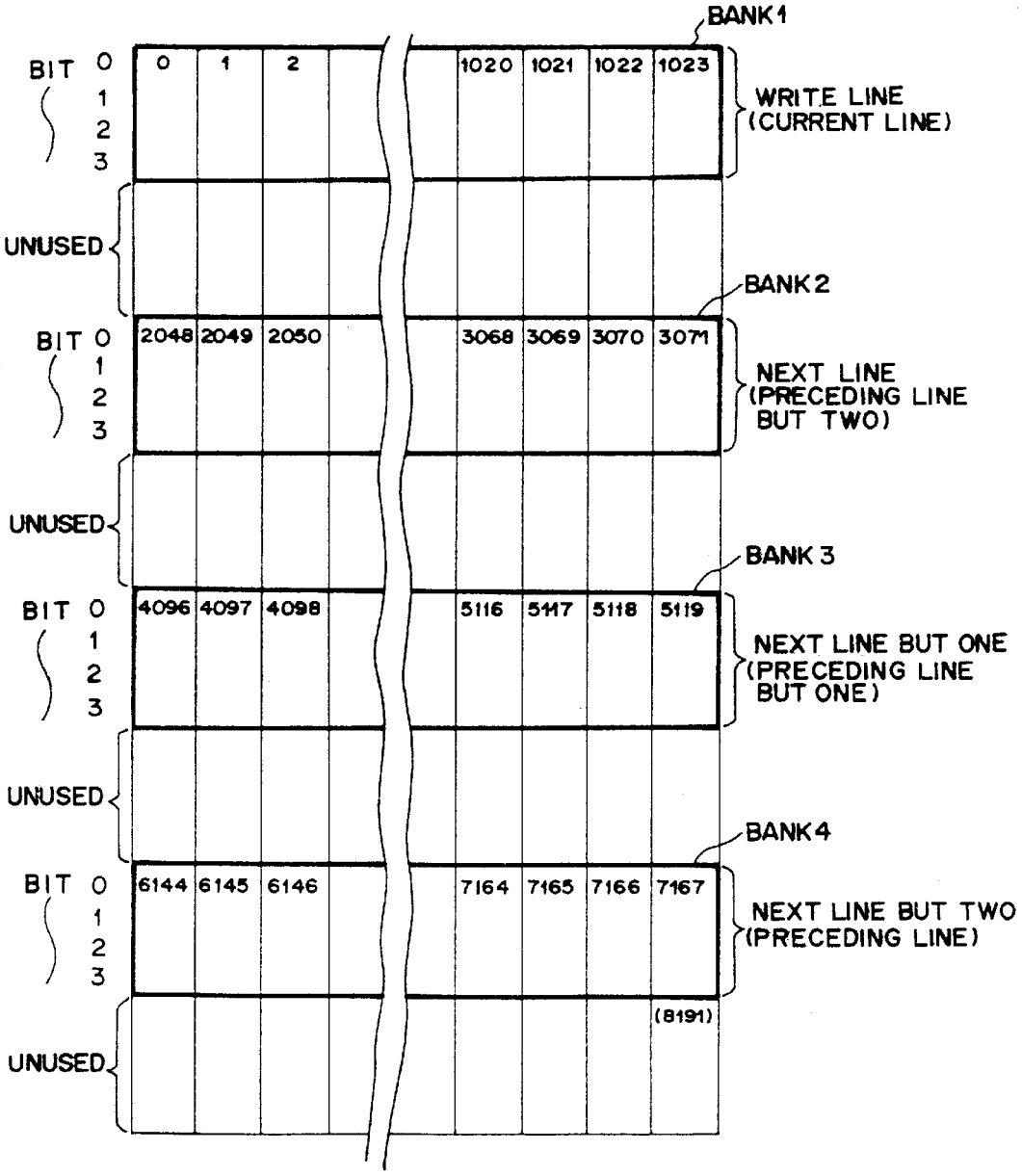
FIG. 5 is a view showing the correspondence between the line image data to be stored in the RAM and the bits and the addresses.

That is, as shown in FIG. 5, the image data for the current line is stored in bank (a collection of addresses) 1, the image data for the next line in bank 2, the image data for the next line but one in bank 3, the image data for the next line but two in bank 4, the image data for the next line but three in bank 1, and so on.

Thus, the image data is stored in the RAM 52 while the bank in which the image data is stored is changed in sequence from the bank 1 to the bank 4 each time the line changes, and this is repeated until read-out of the image on the original 13 is ended.

For the heat-history-based control, the image data for the preceding line (corresponding to the next line but two upon storing of the data) and that for the preceding line but one (corresponding to the next line but one upon storing of the data) are read out for a first data transfer and the image data for the preceding line (corresponding to the next line but two upon storing of the data) is read out for a second data transfer. For example, when the bank in which the image data for the current line is to be written is the bank 1, the image data stored in the bank 4 and that stored in the bank 3 are read out and transferred, and thereafter the image data stored in the bank 4 is again read out and transferred.

Similarly, when the bank in which the image data for the current line is to be written is the bank 2, the image data stored in the bank 1 and that stored in the bank 4 are read out and transferred, and thereafter the image data stored in the bank 1 is again read out and transferred. By one read operation, all the image data stored in bits 0 to 3 are read out from the RAM 52, and the heat-history-based correction image data making section 64 and the output control means 60 select and use the image data group read out from the bit corresponding to each head block.

When the writing and the read-out are considered to be an operation during processing of one line, the writing for the current line, read-out of the preceding line and read-out of the preceding line but one are carried out apparently simultaneously.

However, actually writing data in the RAM 52 and reading out data from the RAM 52 cannot be effected simultaneously. Accordingly, by finely time-sharing the period for processing one picture element and increasing the number of accesses per unit time, the aforesaid operations can be effected apparently simultaneously.

Figure 6:
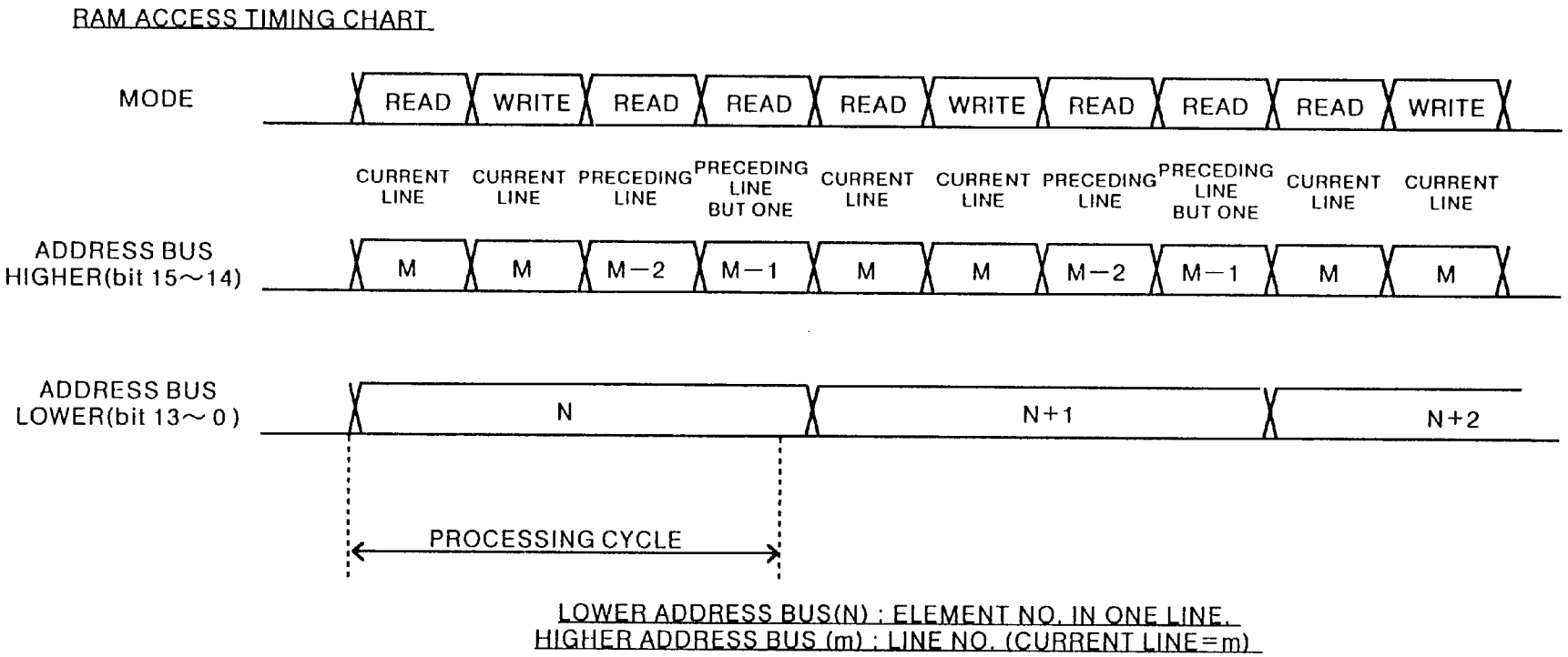
FIG. 6 is a view showing the access timings of the RAM.

In this embodiment, as shown in FIG. 6, the RAM 52 is accessed 4 times in the period for processing one picture element, i.e., read of the current line, writing a the current line, read of the preceding line and read of the preceding line but one. The reason why the read of the current line is effected prior to writing of the current line is to shift the bits of the RAM 52. That is, when writing is effected at a certain address, the data is rewritten in all the bits. Accordingly it is necessary to once read out the data in another bit, to make the data to be written on the basis of the data in said another bit and the data for the bit to be written, and to effect "writing".

Figure 14:
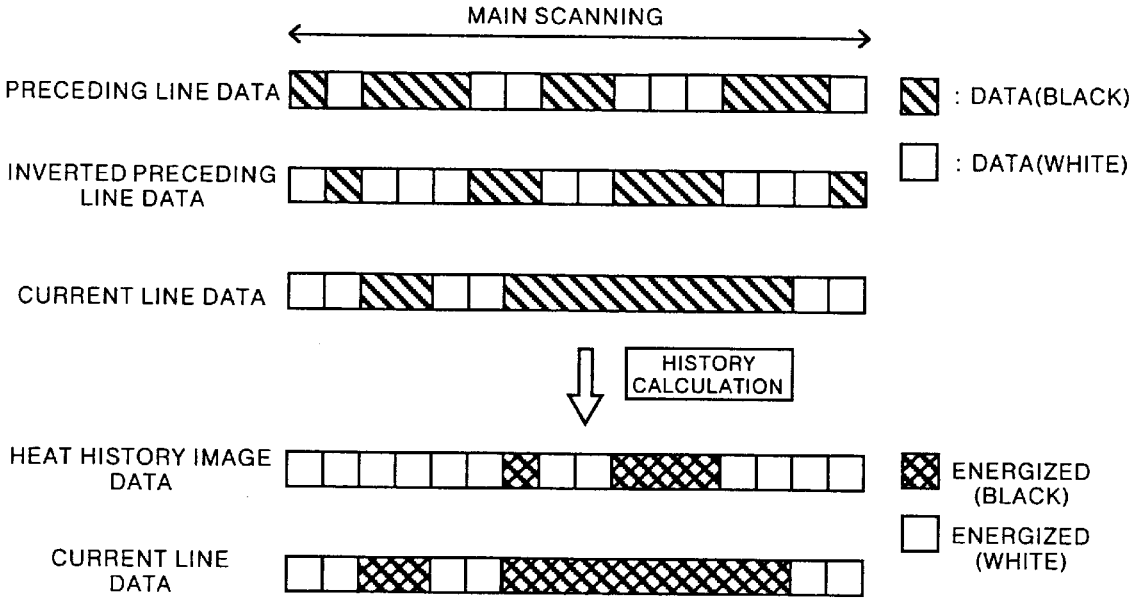
FIG. 14 is a view for illustrating the method of making the heat-history-based correction image data in the system shown in FIG. 13.

Making of heat-history-based correction image data fractions for the heat-history-based control of the thermal head 21 will be described, hereinbelow. In this embodiment, the heat-history-based control is effected in the same manner as that described above with reference to FIG. 14 (time division).

That is, the heat-history-based correction image data making section 64 makes heat-history-based correction image data fractions on the basis of the image data for the preceding line but one (corresponding to the preceding line image data in FIG. 14) and the data for the preceding line (corresponding to the current line image data in FIG. 14) read out from the RAM 52 by the read-out control means 56. That is, the heat-history-based correction image data is obtained by taking a Boolean intersection of inverted data for the preceding line but one and the data for the preceding line. The heat-history-based correction image data made by the heat-history-based correction image data making section 64A is input into the data selecting section 61. The reason why the data for the preceding line but one and the data for the preceding line are used is that the image data fractions for the preceding line but one and the image data fractions for the preceding line are read out as data for driving the thermal head in the processing cycle of one picture element after writing of the current line image data in place of the current line image data and the preceding line image data in FIG. 14. In the following description, the image data for the preceding line but one read out from the RAM 52 is taken as the preceding line image data and the data for the preceding line read out from the RAM 52 is taken as the current line image data for the purpose of the correspondence with the description of FIG. 14.

The data selecting section 61 inputs the heat-history-based correction image data fractions made by the heat-history-based correction image data making section 64 into the corresponding segments 72*a* to 72*d* (FIG. 7) of the TPH drive 72. The segments 72*a* to 72*d* of the TPH drive section 72 drive the blocks 21*a* to 21*d* of the thermal head 21 separately from each other on the basis of a control signal from a TPH control signal generating section 74. After the thermal head 21 is driven according to the heat-history-based correction image data fractions, the current line image data fractions are subsequently input into the TPH drive section 72 from the data selecting section 61 and the thermal head 21 is driven according to the current line image data fractions.

Instead of inputting the heat-history-based correction image data fractions and the current line image data fractions into the TPH drive section 72 in the time division fashion, the heat-history-based correction image data fractions and the current line image data fractions may be combined into head drive data fractions and the combined head drive data fractions may be input into the TPH drive section 72. Further, it is possible to make new data including both information on the heat history and information on the current line on the basis of the current line image data and the preceding line image data without making the heat-history-based correction image data.

Figure 7:
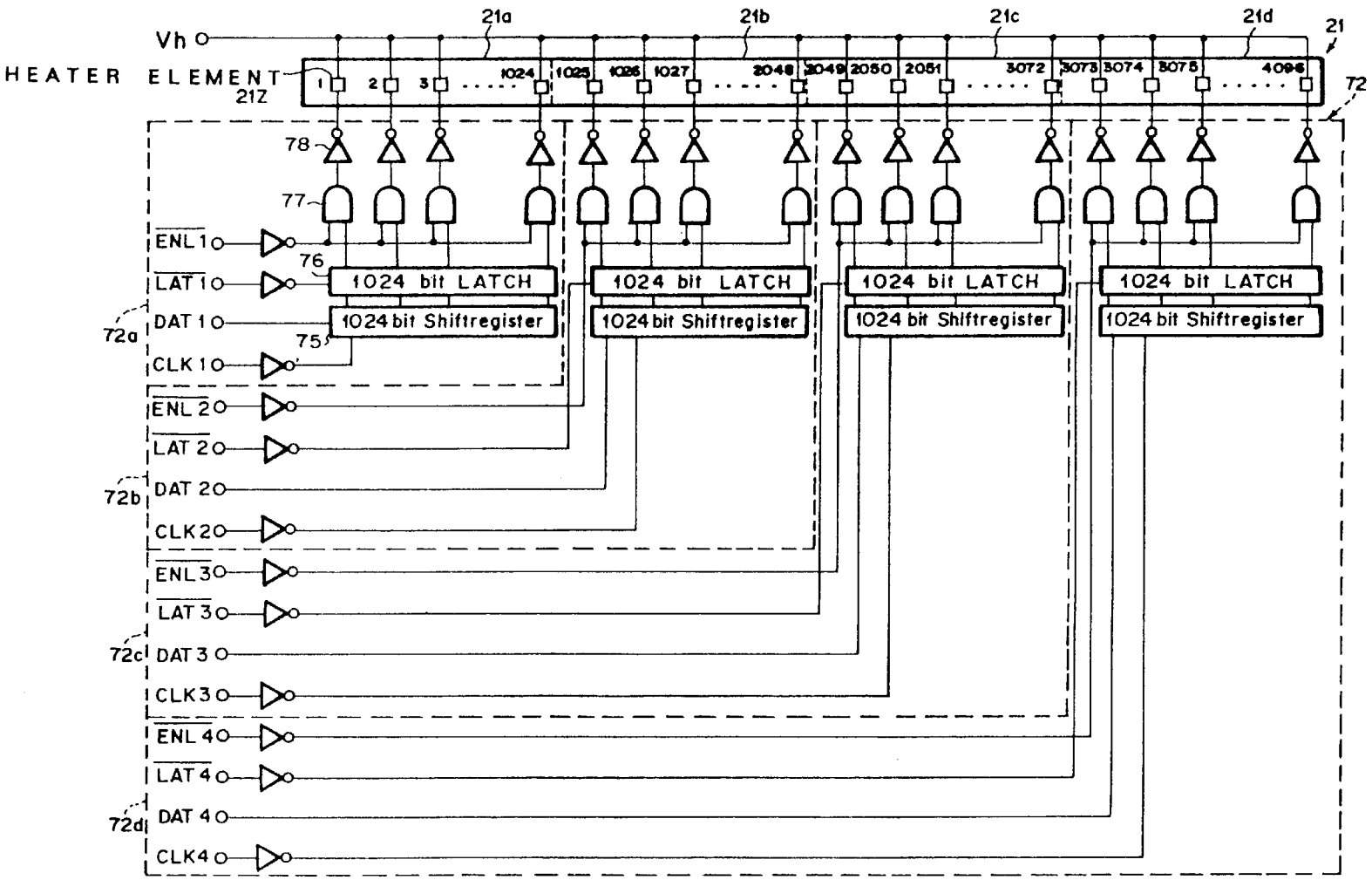
FIG. 7 is a view showing the connection between the TPH drive section and the thermal head.

FIG. 7 shows the connection between the TPH drive section 72 and the thermal head 21. As shown in FIG. 7, the TPH drive section 72 is divided into four segments 72*a* to 72*d* which respectively drive the blocks 21*a* to 21*d* of the thermal head 21. In the normal output where the contiguous multi-imaging is not carried out, the heat-history-based correction image data fraction and the current line image data fraction based on the image data fractions in bit 0 are input into the segment 72*a* of the TPH drive 72 to drive the head block 21*a,* the heat-history-based correction image data fraction and the current line image data fraction based on the image data fractions in bit 1 are input into the segment 72*b* of the TPH drive 72 to drive the head block 21*b,* the heat-history-based correction image data fraction and the current line image data is fraction based on the image data fractions in bit 2 are input into the segment 72*c* of the TPH drive 72 to drive the head block 21*c,* and the heat-history-based correction image data fraction and the current line image data fraction based on the image data fractions in bit 3 are input into the segment 72*d* of the TPH drive 72 to drive the head block 21*d.*

Each image data fraction input from the output control section 62 into the TPH drive 72 is input into a 1024-bit serial input shift register 75 as serial data. Then the serial data is spread by the shift register 75 and is held by a 1024-bit latch 76. The energizing signal ENL and the data held by the latch 76 are input into an AND gate 77 and each heater element 21*z* is energized at a desired timing on the basis of the Boolean intersection of the energizing signal ENL and the data held by the latch 76.

Figure 8:
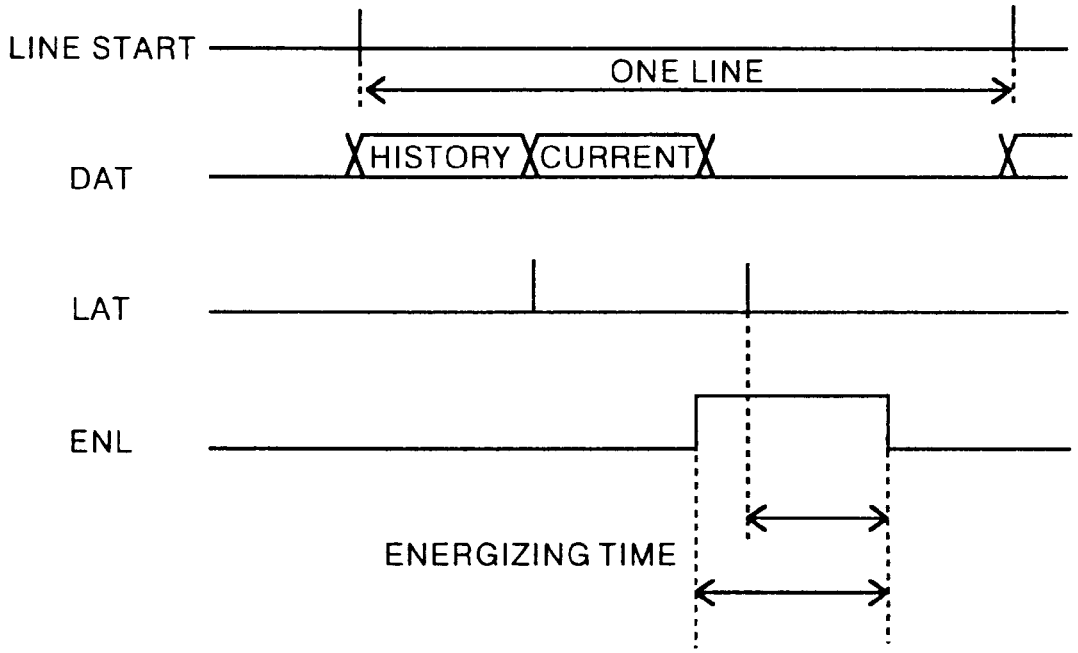
FIG. 8 is a view for illustrating the timing at which each head block is driven on the basis of the heat history data and the current line data.

FIG. 8 is a view for illustrating the timing at which each head block is driven on the basis of the heat-history-based image data fraction and the current line image data fraction. In response to input of a latch signal LAT, the heat-history-based correction image data fraction is held by the latch 76. Then the heater element 21*z* connected to the corresponding AND gate 77 by way of an inverter 78 is energized according to the heat-history-based correction image data fraction held by the latch 76 for a period where the energizing signal is H (high). Then in response to input of another latch signal LAT, the current line image data fraction is held by the latch 76. Then the heater element 21*z* connected to the corresponding AND gate 77 is energized according to the current line image data fraction held by the latch 76 for a period where the energizing signal is H (high).

Figure 9:
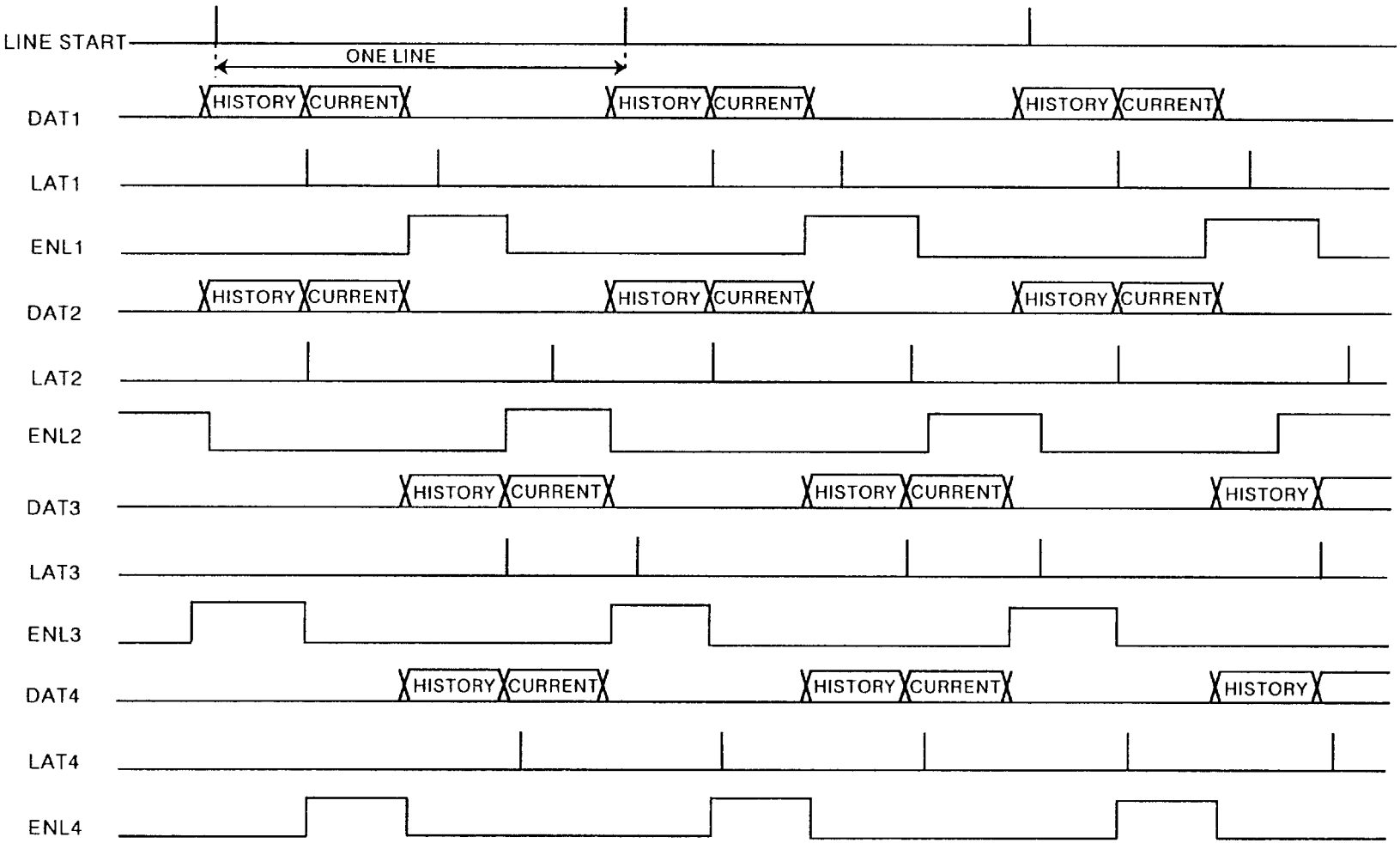
FIG. 9 shows the driving timing for all the blocks of the thermal head.

This operation is carried out for each head block. FIG. 9 shows the driving timing for all the blocks of the thermal head 21.

As can be understood from FIG. 9, heater elements which were not energized by the preceding line image data are energized by both the heat-history-based correction image data and the current line image data, whereby they are energized for a longer time, and heater elements which were energized by the preceding line image data are energized by only the current line image data, whereby they are energized for a shorter time.

Though, in this embodiment, whether each heater element was energized by the preceding line data is taking into account in the heat-history-based control, the heat-history-based control can be better performed by taking into account whether the heater elements around each heater element were energized. Further, though, in this embodiment, data transfer to the thermal head is effected only twice, accuracy of the heat-history-based control can be increased by increasing the number of times of data transfer.

Further, though, in this embodiment, the heat-history-based correction image data fractions and the current image data fractions are input in a time division fashion, data may be input into the thermal head 21 in any way so long as the thermal head 21 is driven by heat-history-based correction image data in which the heat history is taken into account so that deterioration in image quality due to heat history of the thermal head can be avoided.

Figure 10A:
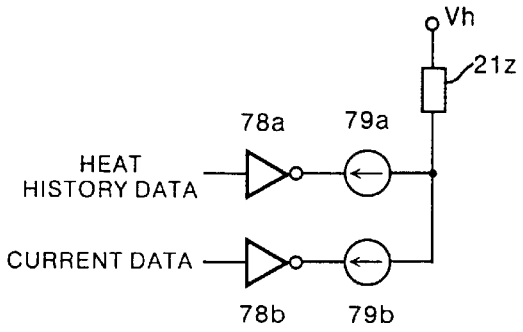
FIGS. 10A and 10B are views showing other ways of driving the thermal head for the heat-history-based control.
Figure 10B:
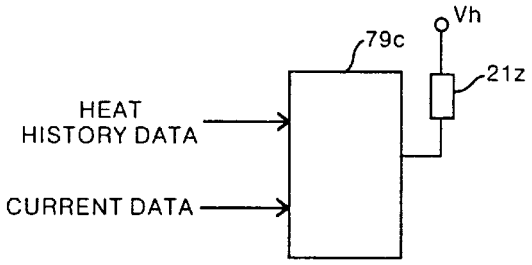

For example, the heat-history-based correction image data and the current line image data are simultaneously input into respective current sources 79*a* and 79*b* to drive the heater element 21*z* by an electric current according to both the heat-history-based correction image data and the current line image data as shown in FIG. 10A, or the heat-history-based correction image data and the current line image data may be combined into new head drive data by a drive signal making means 79*c* and the heater element may be driven by the combined head drive data as shown in FIG. 10B.

The contiguous multi-imaging in the direction of the main scanning can be carried out by changing the relation between the bits and the blocks of the thermal head 21 in the following manner. The image data read out by the image read-out section 10 is stored in the respective bits in the RAM 52 as described above. That is, the image data fractions representing the area 13*a* in FIG. 4A are stored in bit 0 and bit 1 and the image data fractions representing the area 13*b* in FIG. 4A are stored in bit 2 and bit 3. Then the respective image data fractions are read out and the heat-history-based correction image data fractions are made. Up to this step, the contiguous multi-imaging is the same as the normal output operation.

The former differs from the latter in that the heat-history-based correction image data fractions and the current line image data fractions are input into the head blocks 21*a* to 21*d* in the following manner. That is, when two copies of the image of the area 13*a* are to be formed side by side in the direction of the main scanning, the image data fraction stored in bit 0 of the RAM 52 which represents the left half of the image of the area 13*a* is used for controlling the segments 72*a* and 72*c* of the TPH drive section 72 and the image data fraction stored in bit 1 of the RAM 52 which represents the right half of the image of the area 13*a* is used for controlling the segments 72*b* and 72*d* of the TPH drive section 72.

When a multi-imaging signal is input into the data selecting section 61, the heat-history-based correction image data fraction based on the image data fraction stored in bit 0 and the current image data fraction are input into the segments 72*a* and 72*c* of the TPH drive section 72 to drive the head blocks 21*a* and 21*c,* and the heat-history-based correction image data fraction based on the image data fraction stored in bit 1 and the current image data fraction are input into the segments 72*b* and 72*d* of the TPH drive section 72 to drive the head blocks 21*b* and 21*d.* Thus a pair of perforation images each representing the image on the area 13*a* (B6 size) are formed on the stencil master material 23 side by side.

When carrying out such contiguous multi-imaging, the data may be input into the TPH drive section 72 in various ways so long as the respective head blocks 21*a* to 21*d* are driven by the image data fractions representing the image to be multiplied. For example, though, in the embodiment described above, all the current line image data and the preceding line image data are once read out and the heat-history-based correction image data fractions and the current line image data fractions for the image to be multiplied are input into the respective head blocks 21*a* to 21*d,* only the current line image data fraction and the preceding line image data fraction for the image to be multiplied may be read out to form only the heat-history-based correction image data fraction for the image to be multiplied.

As can be understood from the description above, by carrying out the contiguous multi-imaging in the direction of the main scanning twice while changing the position in the direction of the sub-scanning, the contiguous multi-imaging can be carried out over the entire area of the stencil master 23.

The printing operation will be described hereinbelow. The number of copies to be printed is input through the ten-key pad, the number of the copies is displayed by the display means. Then when the start key is pressed, the printing papers 43 are conveyed to the timing roller 42 one by one and the timing roller 42 feeds the printing paper 43 to the conveying passage 41 at a predetermined timing. The printing paper 43 fed to the conveying passage 41 is pressed against the outer surface of the printing drum 33 by the press roller 35 and ink is transferred to the printing paper 43 through the stencil master 23, whereby the printing paper 43 is printed. The printed printing paper 43 is separated from the printing drum 33 by the separator member 39 and discharged to the printing paper discharge table 49. In this manner, a plurality of copies of the image on the B6 size original 13 is printed on the B4 size printing paper 43.

Figure 11A:
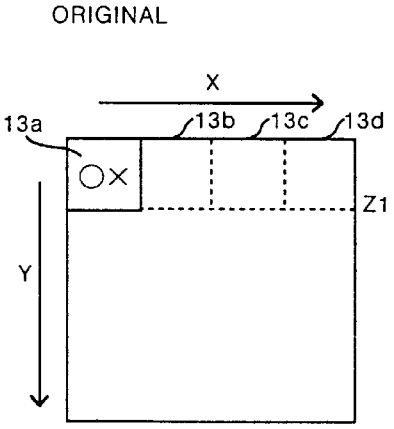
FIGS. 11A and 11B are views showing the correspondence between the original and the stencil master when sixteen copies of the image of the original is to be formed on the stencil master in four rows four in each row.
Figure 11B:
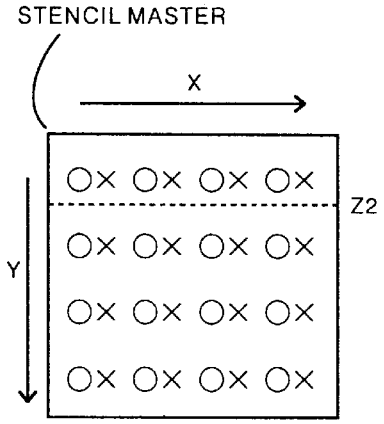

Though, in the embodiment described above, four identical images are formed in two rows two in each row, various types of contiguous multi-imaging can be carried out by repeating contiguous multi-imaging in the direction of the main scanning while changing the position in the direction of the sub scanning. For example, when four copies of an image of an area which is a half in width of the area 13*a* shown in FIG. 4A is to be printed side by side on the B4 size printing paper, the heat-history-based correction image data fraction based on the image data fraction stored in bit 0 and the current image data fraction are input into all the head blocks 21*a* to 21*d* of the thermal head 21. The correspondence between the bit of the RAM 52 and the head blocks 21*a* to 21*d* of the thermal head 21 is changed by the data selecting section 61 into which the multi-imaging signal carrying thereon information on the contiguous multi-imaging to be carried out. The multi-imaging signal basically should designate which part of the image represented by the input image data is to be multiplied and where copies of the part of the image are to be formed. (For example, which part of the image represented by the input image data is to be multiplied can be designated by designating the bit of the RAM 52 and where copies of the part of the image are to be formed can be designated by designating the head block.) Such designation is generally effected by an operator by use of an input means such as a ten-key pad. However, the system may be arranged so that a predetermined number of copies of a predetermined area of an original are automatically formed in predetermined positions of the recording medium, so that a predetermined number of copies of an area of an original designated through an input means are automatically formed in predetermined positions of the recording medium by only designating the area to be multiplied, or so that the system automatically determines the area to be multiplied and the number of copies when no information is input through the input means. Further many other variations of the arrangement of the system can be conceived. In this specification, irrespective of whether the part of the image to be multiplied and the positions where the copies are formed are directly input or are determined on the basis of other factors, it should be interpreted that the part of the image to be multiplied and the positions where the copies are formed are designated by the multi-imaging signal. Depending on the number of copies to be printed in the direction of the main scanning and the number of times by which the contiguous multi-imaging is to be repeated in the direction of the sub-scanning, the number of copies which can be printed side by side in both the directions of the main scanning and the sub-scanning on one B4 size printing paper can be 2, 4, 8, 16 and the like. FIG. 11 shows the case where sixteen identical images are formed in four rows four in each row.

The image to be multiplied need not be limited to those on the upper left side of the original (e.g., area 13*a* in FIG. 4A or FIG. 11A) but may be an image of various areas so long as the size of the area, the number of copies to be printed side by side and the size of the printing paper 43 permit. That is, when the number of copies to be printed side by side in the direction of the main scanning is two and the size of the printing paper 43 is B4, the image to be multiplied may be any one of the areas 13*a* to 13*d* (each of B6 size) shown in FIG. 4A. When the number of copies to be printed side by side in the direction of the main scanning is four and the size of the printing paper 43 is B4, the image to be multiplied may be any one of the areas 13*a* to 13*d* shown in FIG. 11A including one of similar areas below line Z1 each equal to one of the areas 13*a* to 13*d* in size.

Though, in the embodiment described above, the present invention is applied to a system for B4 size, 400 dpi, the present invention may also be applied to other systems such as for A3 side, 400 dpi or A4 size, 300 dpi.

Though, in the embodiment described above, the thermal head 21 has 4096 heater elements which are divided into four blocks, the number of the heater elements and the number of the head blocks need not be limited to these values.

Though, in the embodiment described above, the image data is stored in a memory in bits of the same number as the number of the head blocks, the image data may be stored in other various manners so long as a part of the image data read out from the memory which represents the image to be multiplied can be input into a plurality of head blocks of a number determined according to the number by which the image is to be multiplied. For example, the image data may be stored in a single-bit memory as in the prior art irrespective of whether or not the contiguous multi-imaging is to be carried out and a part of the image data representing the image to be multiplied may be input into a plurality of head blocks of a number determined according to the number by which the image is to be multiplied.

Figure 12:
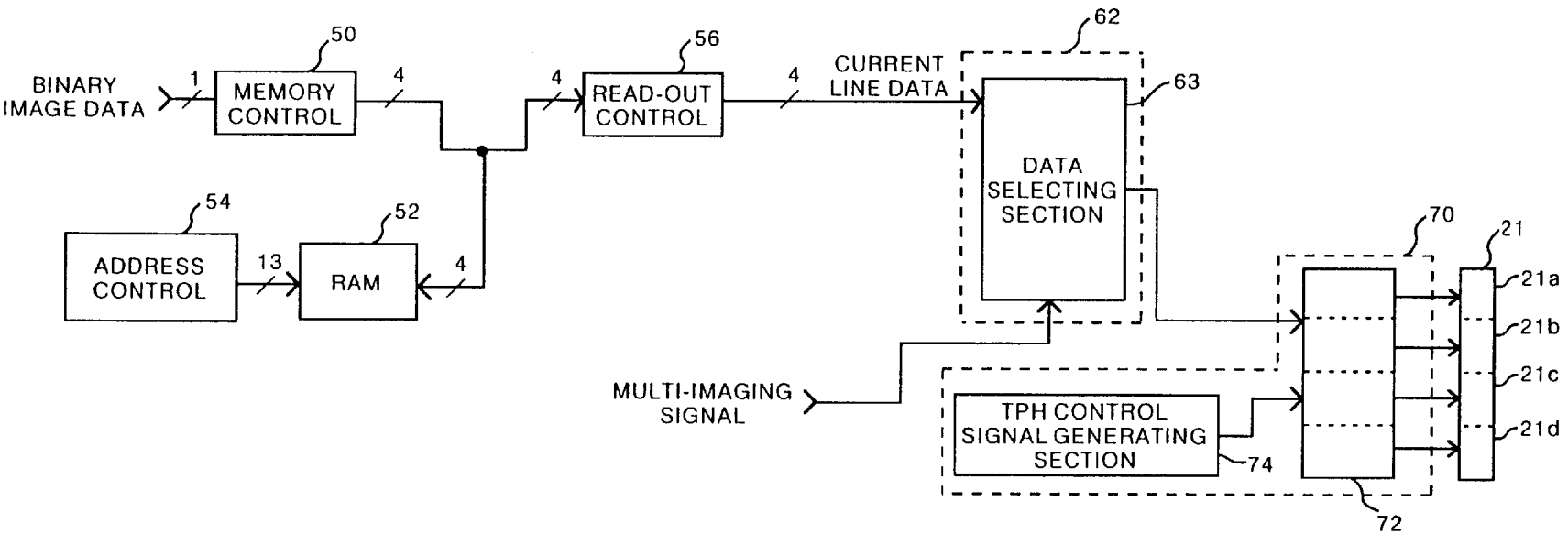
FIG. 12 is a block diagram showing an image forming system which is provided with only contiguous multi-imaging function in accordance with another embodiment of the present invention.
Figure 13:
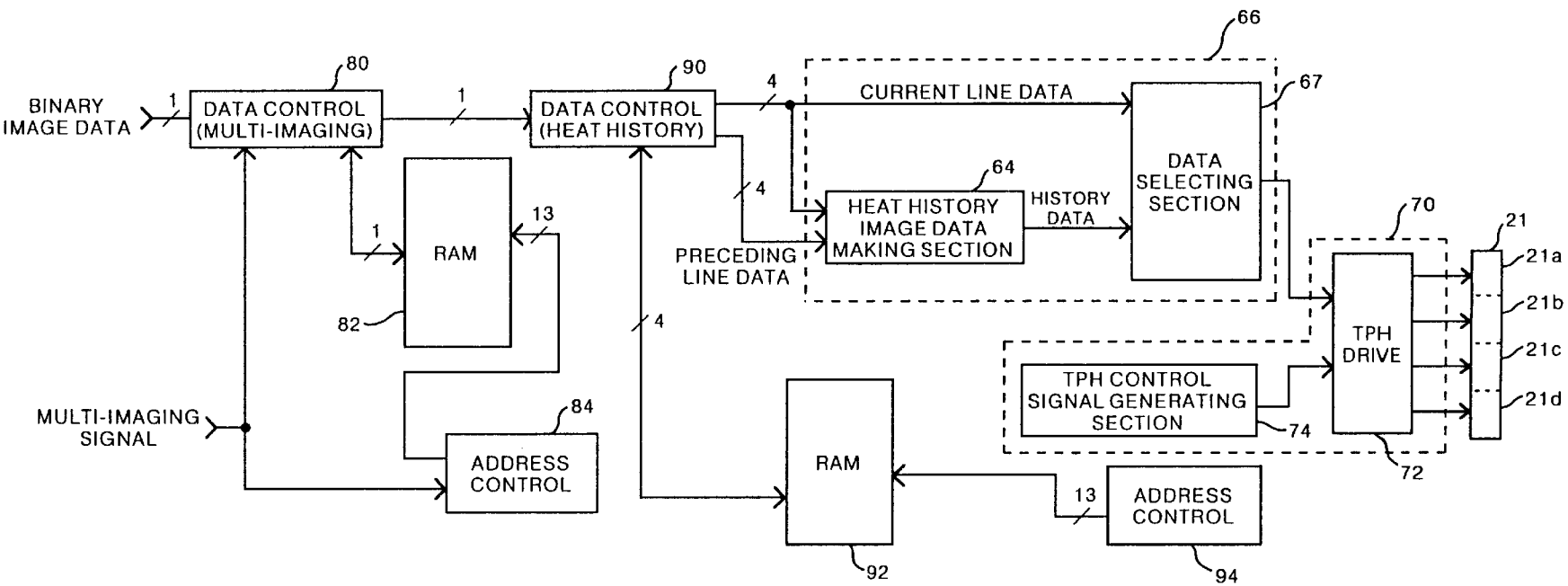
FIG. 13 is a block diagram showing the part for executing contiguous multi-imaging and heat-history-based control of a stencil printer system provided with both a memory for contiguous multi-imaging and a memory for heat-history-based control (as a comparative example)

Further, though, in the embodiment described above, the present invention is applied to a stencil printer, the present invention may be applied to any image forming system so long as it is provided with an output head having a plurality of picture element forming elements which are divided into a plurality of blocks to be driven separately from each other. For example, the present invention can be applied also to a thermal printer in which an image is directly recorded on a heat-sensitive paper by use of a thermal head similar to that employed in the embodiment described above. In the case where the heat-history-based control of the output head need not be carried out, only the current line image data has to be read out from the memory and accordingly the heat-history-based correction image data making section may be eliminated. FIG. 12 shows an image forming system which is provided with only contiguous multi-imaging function. The system shown in FIG. 12 is equivalent to the system shown in FIG. 3 minus the heat-history-based correction image data making section 64 of the output control means 60.

What is claimed is:

1. An image forming system comprising an output head having a linear array of a plurality of image forming elements extending in a first direction, the plurality of image forming elements being divided into a plurality of head blocks which are contiguous in the first direction, and a head drive means which is provided with a plurality of head drive segments of a same number as a number of the plurality of head blocks, each of said plurality of head drive segments driving one of the head blocks separately from each other in one-on-one correspondence, and drives the output head to selectively operate a respective image forming element of the output head according to image data while the output head is being moved relative to a recording medium in a second direction substantially perpendicular to the first direction, thereby forming a copy of the image represented by the image data on the recording medium line by line, a memory in which image data consisting of a plurality of pieces of line image data is stored, each line image data consisting of a plurality of image data fractions of the same number as the number of the head drive segments of the head drive means, the image data fractions being contiguous in the first direction, a contiguous multi-imaging signal generating means which generates a contiguous multi-imaging signal which represents that a plurality of copies of a part of the image represented by the image data are to be formed on the recording medium arranged in the first direction, and designates the part of the image to be multiplied and positions where the copies are to be formed, and an output control means which normally inputs the image data read out from the memory into the head drive means line image data by line image data so that the image data fractions are input into the respective corresponding head drive segments, and when the contiguous multi-imaging signal is generated, inputs the image data fraction of each of the pieces of line image data corresponding to the part of the image to be multiplied designated by the contiguous multi-imaging signal into the head drive segments which drive the head blocks corresponding to the positions where copies are to be formed designated by the contiguous multi-imaging signal in place of the image data fractions of each line image data which is normally to be input into the head drive segments.

2. An image forming system comprising an output head having a linear array of a plurality of image forming elements extending in a first direction, the plurality of image forming elements being divided into a plurality of head blocks which are contiguous in the first direction, and a head drive means which is provided with a plurality of head drive segments of a same number as a number of the plurality of head blocks, each of said plurality of head drive segment driving one of the head blocks separately from each other in one-to-one correspondence, and drives the output head to selectively operate a respective image forming element of the output head according to image data while the output head is being moved relative to a recording medium in a second direction substantially perpendicular to the first direction, thereby forming a copy of the image represented by the image data on the recording medium line by line, a memory which can store a plurality of bits of a number equal to or more than the number of the head blocks at each address, a memory control means which divides each piece of line image data making up the image data into a plurality of image data fractions of the same number as the number of the head drive segments of the head drive means and causes the memory to store the image data fractions in different bits at the same addresses, a read-out control means which reads out the image data fractions of the line image data from the memory, a contiguous multi-imaging signal generating means which generates a contiguous multi-imaging signal which represents that a plurality of copies of a part of the image represented by the image data are to be formed on the recording medium arranged in the first direction, and designates the part to be multiplied of the image and positions where the copies are to be formed, and an output control means which normally inputs the image data read out from the memory into the head drive means line image data by line image data so that the image data fractions are input into the respective corresponding head drive segments, and when the contiguous multi-imaging signal is generated, inputs the image data fraction of each of the pieces of line image data corresponding to the part to be multiplied of the image designated by the contiguous multi-imaging signal into the head drive segments which drive the head blocks corresponding to the positions where the copies are to be formed designated by the contiguous multi-imaging signal in place of the image data fractions of each line image data which is normally to be input into the head drive segments.

3. An image forming system as defined in claim 2 in which the output head is a thermal head.

4. An image forming system as defined in claim 3 in which the memory control means causes the memory to store each line image data with the image data for the preceding line held therein, the read-out control means reads out the image data fractions of the line image data from the memory together with the image data fraction of the line image data for the preceding line, and the output control means, when the contiguous multi-imaging signal is generated, corrects the image data fraction of the line image data corresponding to the part to be multiplied of the image designated by the contiguous multi-imaging signal according to heat history of the heater elements to be driven by the image data fraction represented by the image data fraction of the line image data for the preceding line for the same head block as the image data fraction of the line image data corresponding to the part to be multiplied of the image, thereby forming a corrected head drive data fraction, and inputs the corrected head drive data fraction into the head drive segments which drive the head blocks corresponding to the positions where the copies are to be formed designated by the contiguous multi-imaging signal.

5. An image forming system as defined in claim 4 in which the output control means makes a heat-history-based correction image data fraction for correcting the image data fraction of the line image data corresponding to the part to be multiplied of the image designated by the contiguous multi-imaging signal according to heat history of the heater elements to be driven by the image data fraction represented by the image data fraction of the line image data for the preceding line for the same head block as the image data fraction of the line image data corresponding to the part to be multiplied of the image, and inputs the image data fraction of each of the pieces of line image data corresponding to the part to be multiplied of the image into the head drive segments which drive the head blocks corresponding to the positions where the copies are to be formed in combination with the heat-history-based correction image data fraction.

6. An image forming system as defined in claim 5 in which the heat-history-based correction image data is obtained by taking a Boolean intersection of the image data fraction of each line image data corresponding to the part to be multiplied of the image and the inverted image data fraction of the line image data for the preceding line for the same head block.

* * * * *